US005538147A

United States Patent [19]

Fucci

[11] Patent Number: 5,538,147

[45] Date of Patent: Jul. 23, 1996

[54] WIRE SHELF AND COVER ASSEMBLY

[76] Inventor: Judith G. Fucci, 307 Prospect St., Shrewsbury, Mass. 01545

[21] Appl. No.: 333,250

[22] Filed: Nov. 2, 1994

[51] Int. Cl.[6] ..... A47F 5/00

[52] U.S. Cl. ..... 211/153; 108/90; 211/135

[58] Field of Search ..... 211/106, 90, 187, 211/153, 135, 134, 181, 59.2; 108/90, 180, 181

[56] References Cited

U.S. PATENT DOCUMENTS

| | | | |
|---|---|---|---|
| 3,320,011 | 5/1967 | Sachnoff et al. | 211/153 X |
| 3,545,624 | 12/1970 | Krikorian | 211/153 X |
| 4,519,508 | 5/1985 | Gullett et al. | 211/59.2 |
| 4,756,430 | 7/1988 | Spamer et al. | 211/59.2 |
| 4,899,893 | 2/1990 | Robertson | 211/59.3 |
| 4,947,999 | 8/1990 | Warp | 211/183 |
| 5,119,945 | 6/1992 | Wiggins | 211/59.2 |
| 5,228,581 | 7/1993 | Palladino et al. | 211/135 X |

*Primary Examiner*—Robert W. Gibson, Jr.

*Attorney, Agent, or Firm*—Blodgett & Blodgett

[57] ABSTRACT

A wire shelf and cover assembly is disclosed. The wire shelf has at least two parallel, spaced apart support bars and a plurality of parallel, spaced apart, coplanar cross bars fastened at right angles to the support bars. The cover has a generally planar, rectangular sheet of material adapted to rest upon the cross bars of the wire shelf. A securing mechanism is fastened to the sheet of material and adapted to engage at least a portion of the wire shelf to retain the sheet of material in a fixed position relative to the wire shelf. Preferably the securing mechanism includes at least one tab which is coplanar with the sheet of material and bendable to extend downwardly from at least one of the front edge and the back edge, to fit between an adjacent pair of the cross bars of the shelf, and to lockingly engage the adjacent cross bars. A method of covering the wire shelf, is also disclosed. The sheet of material is rested upon the cross bars of the wire shelf and the tab is bent between an adjacent pair of the cross bars to retain the sheet of material in a fixed position relative to the wire shelf. The pair of adjacent cross bars of the wire shelf is seated in a pair of opposing notches in the periphery of the tab.

16 Claims, 4 Drawing Sheets

WIRE SHELF AND COVER ASSEMBLY

BACKGROUND OF THE INVENTION

The field of the invention relates generally to shelf coverings, and more particularly, pertains to coverings for wire shelves.

Wire shelves are commonly used in new building construction and appear, especially, in both closets and kitchen pantries. Their popularity stems from their low cost, attractive appearance, easy removal from the closet or pantry, and light weight.

Nevertheless, several problems have already surfaced with this type of shelf. Because of the raised, parallel cross-bars, clothing such as sweaters or shirts, when folded and rested upon the shelf, often assumes the pattern of the cross-bars, requiring re-ironing or at least a period of time to hang out.

Additionally, when upright items are placed upon the shelf, the spacing between the cross-bars can cause the items to tip over, especially when the items are somewhat small.

Still another problem arises when the protective coating on the wire shelves begins to wear with use. The exposed metal, when subjected to damp items or the moisture of certain climates, can rust, causing damage to clothing or other items.

Further, because of the particular construction of this type of shelf, there are many crevices at the junctures of the cross-bars and the support bars which are at right angles to the cross-bars. These crevices, and the overall shape of the wires, make cleaning of mildew and other dirt from these shelves a nearly impossible task. This problem makes this type of shelf less than ideal for situations where hygiene is especially important, such as in a hospital, medical office or dental office.

Individuals have tried to solve these types of problems with informal solutions such as cutting a rectangular shaped piece of cardboard to rest on top of the wire shelf. However, this type of cover is prone to unwanted sliding, offers an aesthetically unattractive appearance, and is generally uncleanable.

These and other difficulties experienced with the prior art solutions have been obviated in a novel manner by the present invention.

It is, therefore, a principal object of the invention to provide a novel wire shelf and cover assembly which will avoid line imprinting on clothing due to the raised cross-bars characteristic of wire shelves.

Another object of this invention is the provision of a wire shelf and cover assembly which will prevent items from tipping over or falling through the cross-bars of the wire shelf.

A further object of the present invention is the provision of such a wire shelf and cover assembly wherein the cover may be retained in a fixed position relative to the wire shelf.

It is another object of the instant invention to provide a wire shelf and cover assembly wherein the cover may be conveniently sized for the wire shelf.

A still further object of the invention is the provision of a wire shelf and cover assembly wherein the cover is easy to install on the wire shelf.

It is a further object of the present invention to provide a wire shelf and cover assembly which will protect clothing and other objects from the adverse effects of rust or mildew.

It is a still further object of the present invention to provide a wire shelf and cover assembly that is easy to clean and therefore hygienic.

Another object of the invention is the provision of a wire shelf and cover assembly which is simple in construction, which is inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

It has now been found that the forgoing and related objects may be readily attained in a cover which is adapted for use with a wire shelf. The wire shelf has at least two parallel, spaced apart support bars and a plurality of parallel, spaced apart, coplanar cross bars fastened at right angles to the support bars. The cover has a generally planar, rectangular sheet of material which is adapted to rest upon the cross bars of the wire shelf. A securing means is fastened to the sheet of material and adapted to engage at least a portion of the wire shelf to retain the sheet of material in a fixed position relative to the wire shelf.

Preferably, the sheet of material is flexible and has a front edge, a back edge, a pair of side edges and a generally flat surface for resting on the cross bars of the wire shelf. The securing means preferably includes at least one tab which is coplanar with the sheet of material and bendable to extend downwardly from at least one of the from edge and the back edge of the sheet of material, to fit between an adjacent pair of the cross bars of the shelf, and to lockingly engage the adjacent cross bars, thus retaining the sheet of material in a fixed position relative to the wire shelf. The tab has a score line at the juncture of the tab and the sheet of material, to facilitate the downward bending of the tab from the sheet of material.

Desirably, the tab also has an outer tapered portion to facilitate the insertion of the tab between the adjacent pair of cross bars. The periphery of the tab has a pair of opposing notches at the juncture of the tab and the sheet of material and the tab is integral with the sheet of material.

In another embodiment, the sheet of material is provided with ribs on the generally flat surface. The ribs extend between the front edge and the back edge and at right angles thereto to facilitate the retention of the sheet of material in a fixed position relative to the wire shelf.

Preferably, the sheet of material has at least one line of perforation extending between its front edge and its back edge and at right angles thereto to facilitate the dimensioning of the sheet of material to a length similar to the length of the wire shelf with which it is adapted to be used. The sheet of material is made of a synthetic resin which is preferably polystyrene, and has a thickness of from about 0.010 inches to about 0.020 inches.

In the method of covering a wire shelf, the sheet of material is rested upon the cross bars of the wire shelf, and the tab is bent between an adjacent pair of the cross bars to retain the sheet of material in a fixed position relative to the wire shelf. The pair of adjacent cross bars of the wire shelf is seated in the opposing notches in the periphery of the tab.

DESCRIPTION OF THE PREFERRED EMBODIMENT

Figure 1:
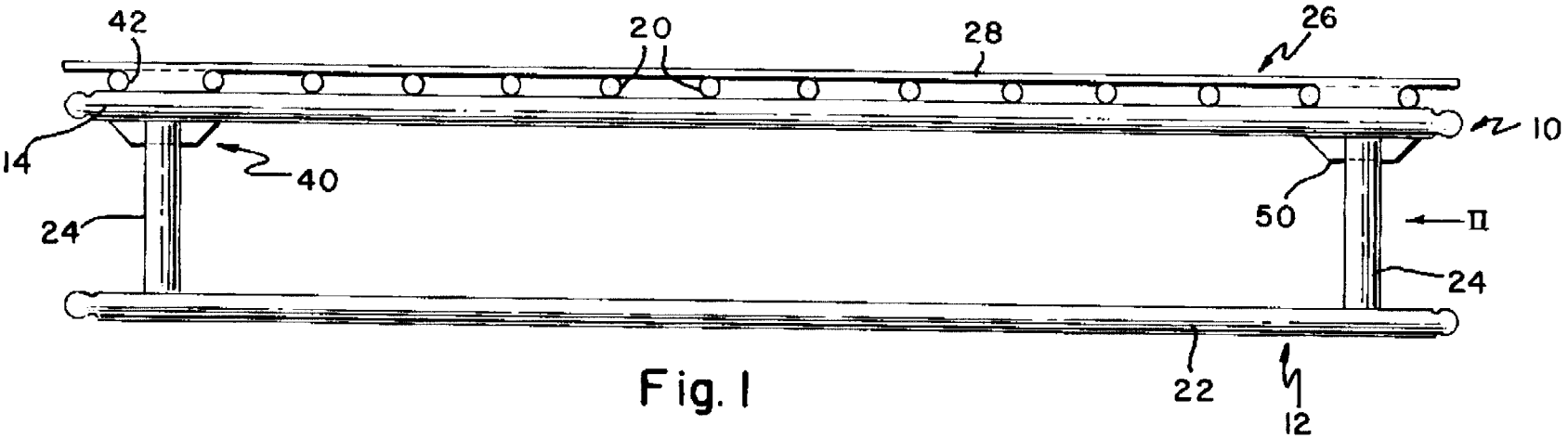
FIG. 1 is a front elevational view of a wire shelf and cover assembly, embodying the principles of the present invention.
Figure 2:
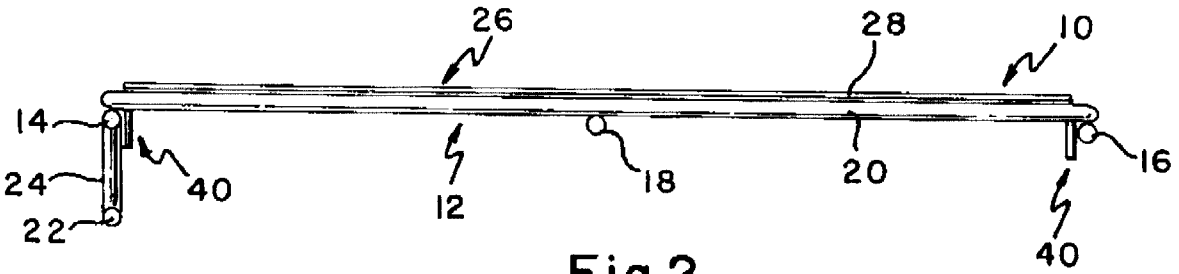
FIG. 2 is an end view of the wire shelf and cover assembly of FIG. 1, looking in the direction of arrow II in FIG. 1.
Figure 3:
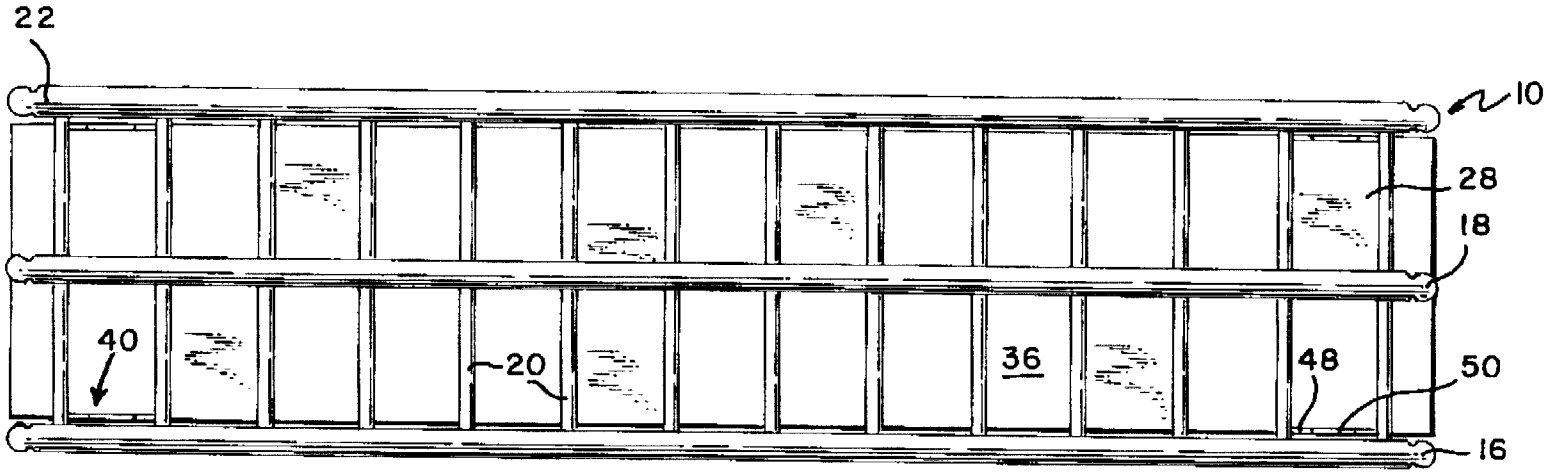
FIG. 3 is a bottom plan view of the wire shelf and cover assembly of FIG. 1.

With reference now to the drawings, there is shown in FIGS. 1, 2 and 3, a wire shelf and cover assembly, embodying the principles of the present invention, and generally indicated by the reference numeral 10. The wire shelf and cover assembly 10 is comprised of a wire shelf, generally indicated by the reference numeral 12, and a cover, generally indicated by the reference numeral 26.

The wire shelf 12 has a front support bar 14, a back support bar 16 and a middle support bar 18 positioned parallel to each other, spaced apart and coplanar. A plurality of cross bars 20 are evenly spaced and fastened at right angles to the front support bar 14, the back support bar 16, and the middle support bar 18. The cross bars 20 are therefore also coplanar.

A lower support bar 22 is positioned parallel to and beneath the front support bar 14 and retained in position by means of a vertical support member 24 fastened adjacent each end of the lower support bar 22 and adjacent each end of the front support bar 14. The lower support bar 22 is used for hanging clothes hangers (not shown) from the wire shelf 12.

The cover 26 is comprised of a generally planar, rectangular sheet 28 of flexible material and is configured and dimensioned to lie upon the cross bars 20. As is best seen in FIGS. 3 and 4, the sheet 28 is dimensioned to almost entirely cover the cross bars 20.

Figure 4:
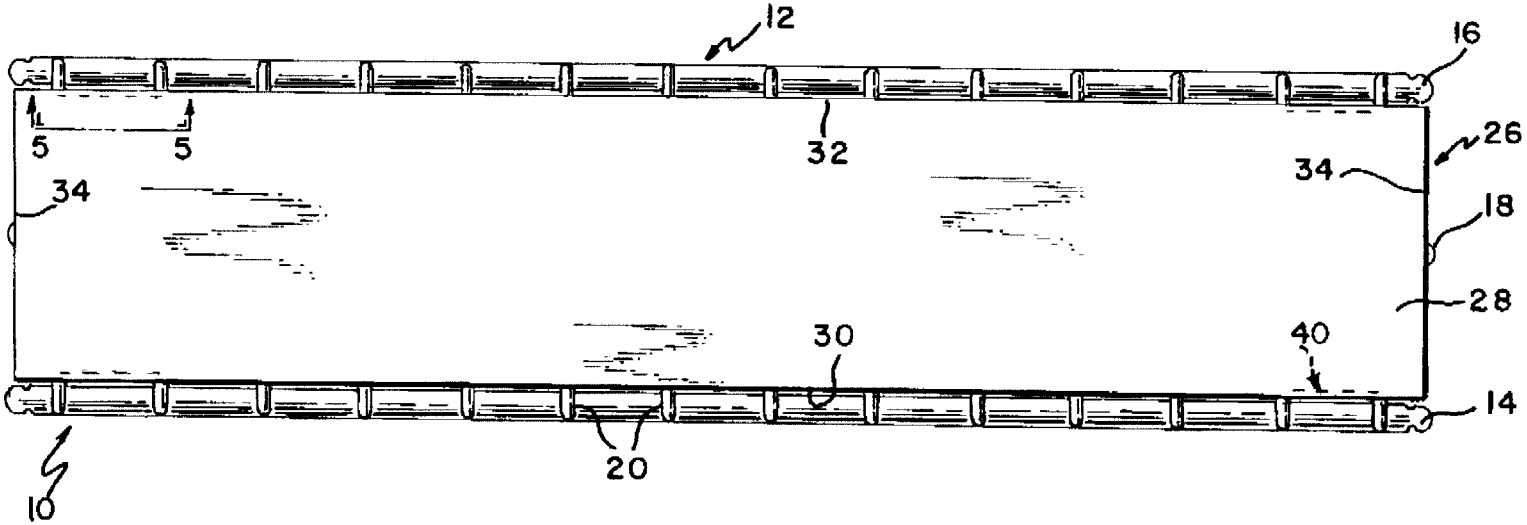
FIG. 4 is a top plan view of the wire shelf and cover assembly of FIG. 1.

Referring to FIG. 4, the sheet 28 is seen as having a front edge 30, a back edge 32, and a pair of side edges 34. As shown in FIG. 3, the sheet 28 has a generally flat surface 36 configured to lie upon the cross bars 20.

Figure 6:
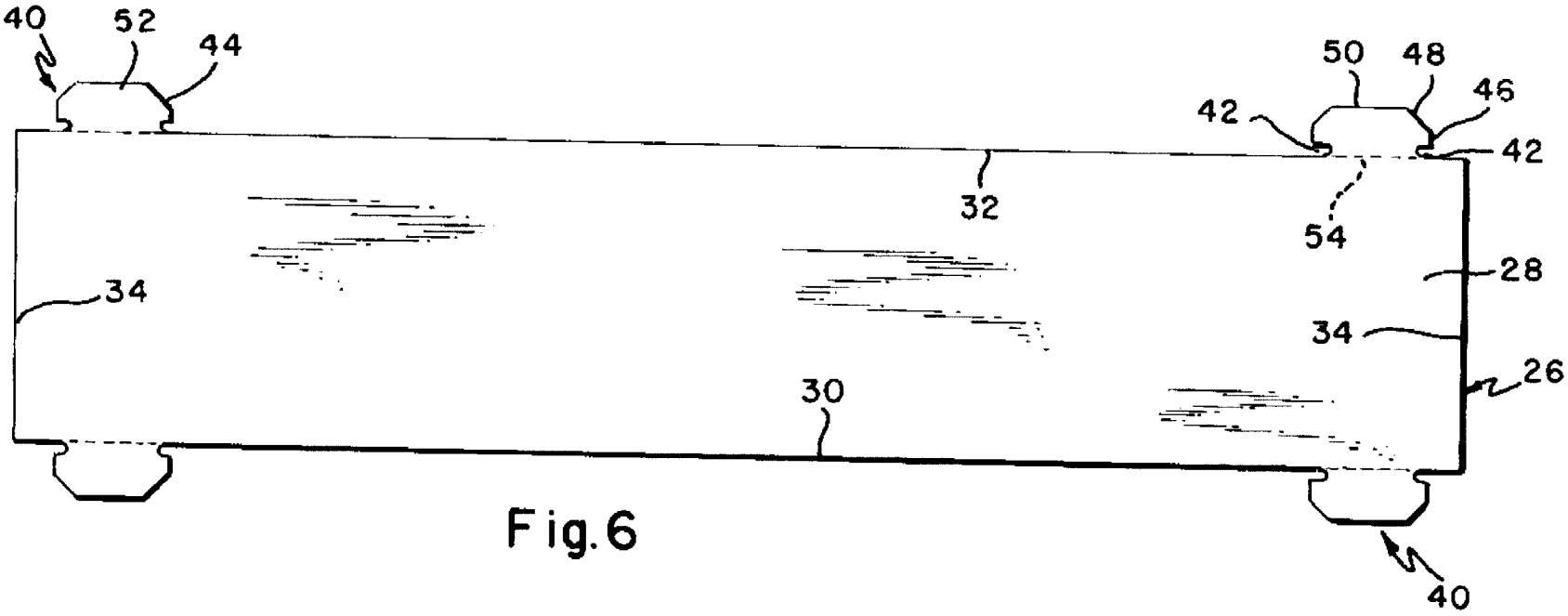
FIG. 6 is a top plan view of the cover of FIG. 1.

Referring to FIG. 6, one or more tabs, generally indicated by the reference numeral 40, are integral with the sheet 28 and extend outwardly from both the front edge 30 and the back edge 32. The tab 40 is bendable to extend downwardly from either the front edge 30 or the back edge 32.

Each tab 40 has a pair of notches 42 in the periphery 44 of the tab 40 at the juncture of the tab 40 and the sheet 28. Each tab 40 also has a parallel edge 46 which extends outwardly from each of its corresponding notches 42 and at a right angle to the sheet 40. Each tab 40 further has a tapered edge 48 which extends outwardly from the distal portion of each parallel edge 46 and toward the other tapered edge 48. The distal ends of each tapered edge 48 are joined by a distal edge 50. The tapered edges 48 and the distal edge 50 bound an outer tapered portion 52 of the tab 40.

A score line 54 is also provided at the juncture of the tab 40 and the sheet 28 and facilitates the downward bending of the tab 40 with respect to the sheet 28.

Figure 7:
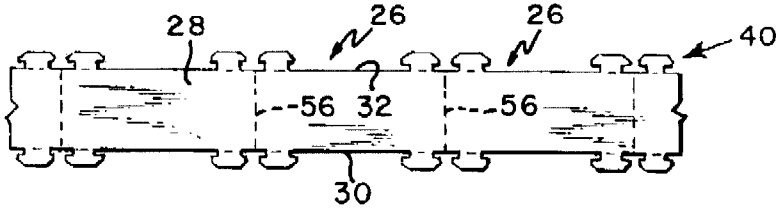
FIG. 7 is a top plan view, drawn to a reduced scale, of a series of the covers of FIG. 1, shown connected and with perforations between adjacent covers.

FIG. 7 shows a series of covers 26 each separated from its adjacent covers 26 by lines of perforation 56, to facilitate the separation of a cover 26 from a roll of covers 26. Each line of perforation 56 extends between the front edge 30 and the back edge 32 of a sheet 28 and at right angles to the front edge 30 and back edge 32. The lines of perforation 56 can be conveniently spaced for standard shelf lengths such as 2 feet, 4 feet, 6 feet, 8 feet, and so on. Alternatively to, or in addition to, the lines of perforation 56, a repeating printed design of known spacing (not shown) can provide assistance in allowing the user to cut the cover 26 to a known length.

Dimensionally, the sheet 28 will typically have a depth of 11¼ inches for a shelf that is 12 inches deep, a depth of 15¼ inches for a shelf that is 16 inches deep, and a depth of 17¼ inches for a shelf that is 18 inches deep. The sheet 28 has a thickness of from about 0.010 inches to about 0.020 inches. The tabs 40 are spaced apart at fixed intervals, typically 12 inches from center to center.

The width of the tab 40 will typically be 1 inch or ½ inch depending upon the spacing of the cross bars 20 of the wire shelf 12.

The sheet 28 is preferably formed of polystyrene. Materials that could also be used for the sheet 28 include polycarbonate, such as is sold under the trademark LEXAN by GE Plastics, polyvinyl chloride film, or a condensation polymer film of phthalic acid and ethylene glycol, or related compounds, such as is sold under the trademark MYLAR.

The invention having been thus described, the operation will now be clear to those of ordinary skill in the art as described below.

The user of the wire shelf and cover assembly 10 who is desirous of covering the wire shelf 12 with a cover 26 will generally start with a series of covers 26 as shown in FIG. 7. Using the lines of perforation 56 and/or a repeating design (not shown) printed on the cover 26, or simply a ruler (not shown), the user will dimension the cover 26 to a length appropriate for the size of the wire shelf 12 that is sought to be covered. Once the cover 26 is properly dimensioned, the generally flat surface 36 of the cover 26 is rested upon the cross bars 20 so as to cover the majority of the extent of the cross bars 20.

Figure 5:
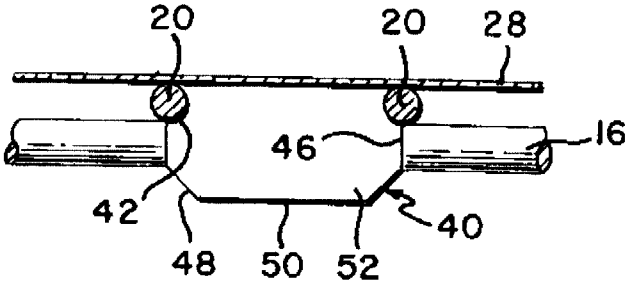
FIG. 5 is a fragmentary, horizontal sectional view of the wire shelf and cover assembly of FIG. 4, taken along the line 5—5 thereof, and looking in the direction of the arrows.

The tabs 40, which prior to installation of the cover 26 are generally coplanar with the generally rectangular sheet 28, are bent downwardly to extend at approximately a right angle from either the front edge 30 or the back edge 32 of the sheet 28. As shown in FIG. 5, each of the tabs 40 is therefore fit between an adjacent pair of cross bars 20 of the shelf 12 in order to lockingly engage the adjacent cross bars 20 and thereby retain the sheet 28 of material in a fixed position relative to the wire shelf 12. The outer tapered portion 52 of each of the tabs 40 facilitates the insertion of the tab 40 between the adjacent pair of cross bars 20. After the tab 40 is bent downwardly between the adjacent pair of cross bars 20, each of the adjacent pair of cross bars 20 is seated in the opposing notches 42.

Figure 8:
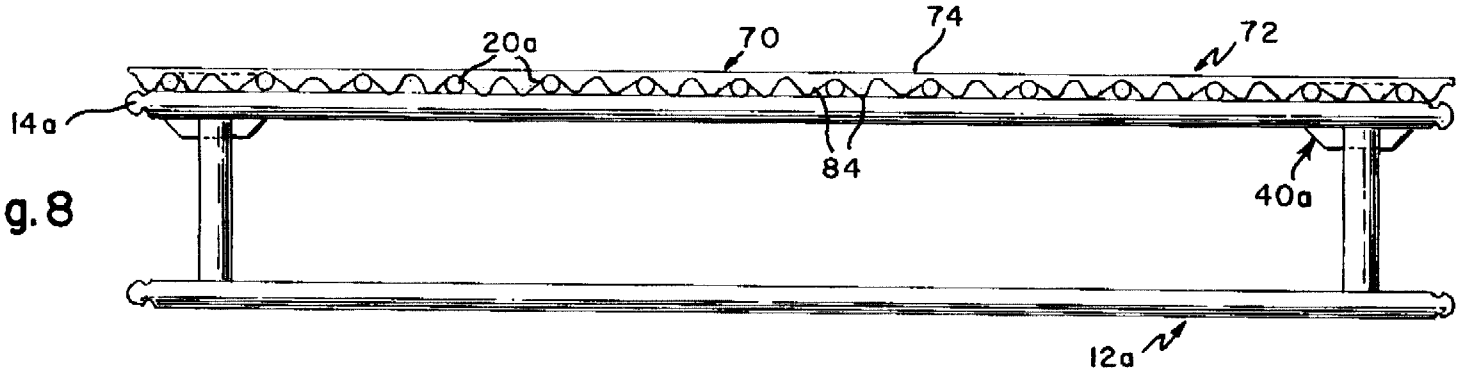
FIG. 8 is a front elevational view of an alternate embodiment of a wire shelf and cover assembly, embodying the principles of the present invention.
Figure 9:
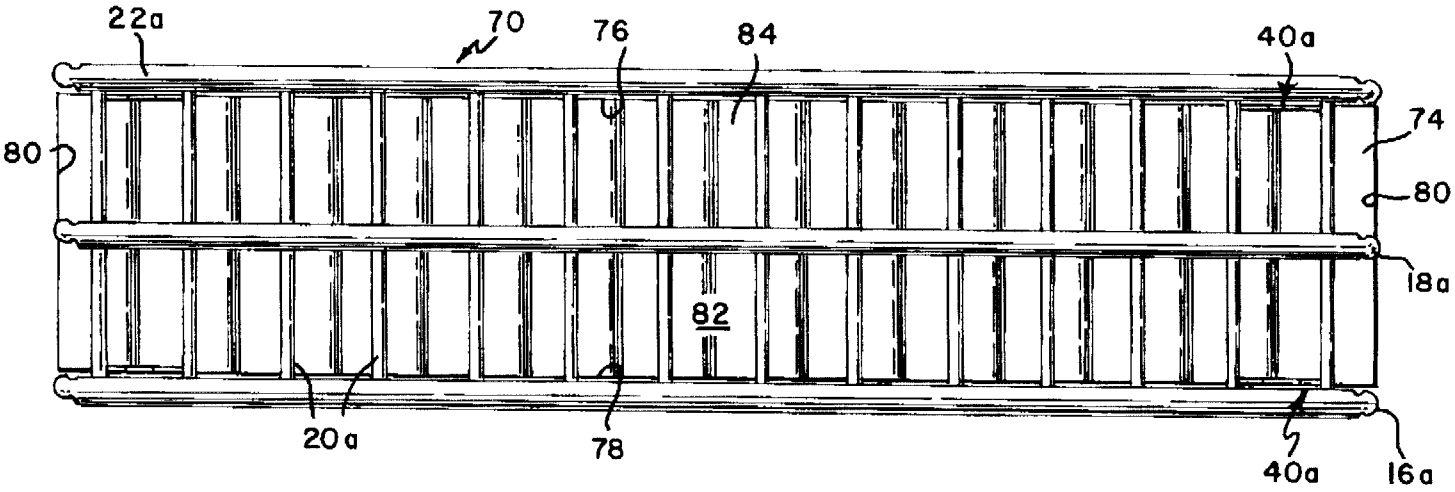
FIG. 9 is a bottom plan view of the wire shelf and cover assembly of FIG. 8.

Referring to FIGS. 8 and 9, them is shown an alternate embodiment of the wire shelf and cover assembly, embodying the principals of the present invention, and generally indicated by the reference numeral 70.

In this embodiment, elements having reference numerals with a suffix are identical to elements with the same numeral, but no suffix, in the previous embodiment.

The wire shelf and cover assembly 70 is comprised of a wire shelf, generally indicated by the reference numeral 12*a*, and a cover, generally indicated by the reference numeral 72.

The cover 72 is comprised of a generally planar, rectangular sheet 74 of flexible material and is configured and dimensioned to lie upon the cross bars 20*a*. As is best seen in FIG. 9, the sheet 74 is dimensioned to almost entirely cover the cross bars 20*a*.

Referring still to FIG. 9, the sheet 74 is seen as having a front edge 76, a back edge 78, and a pair of side edges 80. The sheet 74 has a generally flat surface 82 configured to lie upon the cross bars 20*a*.

The generally flat surface 82 of the sheet 74 is provided with integral ribs 84, which extend between the front edge 76 and the back edge 78. The ribs 84 are disposed at right angles to the front edge 76 and the back edge 78 and are evenly spaced.

As shown in FIGS. 8 and 9, one or more tabs, generally indicated by the reference numeral 40*a*, are integral with the sheet 74 and extend outwardly from both the front edge 76 and the back edge 78. The tab 40*a* is bendable to extend downwardly from either the front edge 76 or the back edge 78. A score line (not shown) is also provided at the juncture of the tab 40*a* and the sheet 74 and facilitates the downward bending of the tab 40*a* with respect to the sheet 74.

As with the first embodiment, the covers 72 may also be provide in a roll of covers 72 wherein each cover 72 is separated from its adjacent covers 72 by lines of perforation (not shown), to facilitate the separation of a cover 72 from a roll of covers 72. Each line of perforation (not shown) extends between the front edge 76 and the back edge 78 of a sheet 74 and at right angles to the front edge 76 and back edge 78. The lines of perforation (not shown) can be conveniently spaced for standard shelf lengths such as 2 feet, 4 feet, 6 feet, 8 feet, and so on. Alternatively to, or in addition to, the lines of perforation (not shown), a repeating printed design of known spacing (not shown) can provide assistance in allowing the user to cut the cover 72 to a known length.

The sheet 74 is dimensioned in the same manner as the sheet 28 of the previous embodiment, but the ribs 84 are in addition to a thickness of from about 0.010 inches to about 0.020 inches. The ribs 84 extend downwardly from the generally flat surface 82 for a distance of approximately ⅛ inches to correspond to the cross-sectional diameter of the cross-bars 20*a*. Adjacent ribs 84 are spaced so as to permit the cross-bars 20*a* to seat snugly therebetween.

As in the first embodiment, the tabs 40*a* are spaced apart at fixed intervals, typically 12 inches from center to center.

The materials employed in this embodiment are the same as those for the first embodiment.

In use, this embodiment is employed in a manner similar to the first embodiment. However, when the generally flat surface 82 of the cover 72 is rested upon the cross bars 20*a*, care is taken to fit each cross bar 20*a* between an adjacent pair of ribs 84, thereby facilitating the retention of the sheet 74 in a fixed position relative to the wire shelf 12*a*.

Thus, it can be seen from the foregoing detailed specification and attached drawings that the wire shelf and cover assembly of the present invention will avoid line imprinting on clothing and will prevent items from tipping over or falling through the cross-bars of the wire shelf. The cover may be retained in a fixed position relative to the wire shelf and may be conveniently sized for the wire shelf with which it is used. Furthermore, the cover is easy to install on the wire shelf, and will serve to protect clothing and other objects from the adverse effects of rust or mildew. Since the cover is easy to clean, it may be used in hygienic situations. Also, the wire shelf and cover assembly is simple in construction, inexpensive to manufacture, and capable of a long life of useful service with a minimum of maintenance.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A cover, adapted for use with a wire shelf, the wire shelf having at least two parallel, spaced apart support bars and a plurality of parallel, spaced apart, coplanar cross bars fastened at right angles to the support bars, said cover comprising:

(a) a generally planar, flexible, rectangular sheet of material adapted to rest upon the cross bars of the wire shelf, said sheet of material having a front edge, a back edge, a pair of side edges and a generally flat surface for resting on the cross bars of the wire shelf; and (b) at least one tab which is integral with said sheet of material and coplanar therewith, and bendable to extend downwardly from at least one of said front edge and said back edge, to fit between an adjacent pair of the cross bars of the shelf, and to lockingly engage the adjacent cross bars, thus retaining said sheet of material in a fixed position relative to the wire shelf.

2. The cover of claim 1 wherein said sheet of material is provided with ribs on said generally flat surface of said sheet of material, said ribs extending between said front edge and said back edge and at right angles thereto to facilitate the retention of said sheet of material in a fixed position relative to the wire shelf.

3. A cover and wire shelf assembly comprising:

(a) a wire shelf having at least two parallel, spaced apart support bars and a plurality of parallel, spaced apart, coplanar cross bars fastened at right angles to said support bars;

(b) a generally planar, flexible, rectangular sheet of material, made of polystyrene and having a thickness of from about 0.010 inches to about 0.020 inches, and adapted to rest upon said cross bars of said wire shelf, said sheet of material having a front edge, a back edge, a pair of side edges and a generally flat surface for resting on said cross bars of said wire shelf, said sheet of material being provided with ribs on said generally flat surface of said sheet of material, said ribs extending between said front edge and said back edge and at right angles thereto to facilitate the retention of said sheet of material in a fixed position relative to said wire shelf, said sheet of material having at least one line of perforation extending between said front edge and said back edge and at right angles thereto to facilitate the dimensioning of said sheet of material to a length similar to the length of said wire shelf with which it is adapted to be used; and (c) at least one tab which is integral with said sheet of material and coplanar therewith, said tab being bendable to extend downwardly from at least one of said from edge and said back edge, to fit between an adjacent pair of said cross bars of said shelf, and to lockingly engage said adjacent cross bars, thus retaining said sheet of material in a fixed position relative to said wire shelf, said tab having an outer tapered portion to facilitate the insertion of said tab between said adjacent pair of cross bars, said tab being provided with a score line at the juncture of said tab and said sheet of material, to facilitate the downward bending of said tab from said sheet of material, the periphery of said tab having a pair of opposing notches at the juncture of said tab and said sheet of material.

4. A method of covering a wire shelf, comprising the steps of:

(a) providing a wire shelf having at least two parallel, spaced apart support bars and a plurality of parallel, spaced apart, coplanar cross bars fastened at right angles to said support bars;

(b) providing a generally planar, flexible, rectangular sheet of material adapted to rest upon said cross bars of said wire shelf, said sheet of material having a front edge, a back edge, a pair of side edges and a generally flat surface for resting on the cross bars of said wire shelf, said sheet of material having at least one tab which is coplanar with the sheet of material and bendable to extend downwardly from at least one of said front edge and said back edge, to fit between an adjacent pair of said cross bars of said shelf, and to lockingly engage said adjacent cross bars;

(c) resting said sheet of material upon said cross bars of said wire shelf;

(d) bending said tab between an adjacent pair of said cross bars to retain said sheet of material in a fixed position relative to said wire shelf.

5. The method of claim 4 wherein the periphery of said tab has a pair of opposing notches at the juncture of said tab and said sheet of material, and including the step of seating said pair of adjacent cross bars of said wire shelf in said notches.

6. A cover, adapted for use with a wire shelf, the wire shelf having at least two parallel, spaced apart support bars and a plurality of parallel, spaced apart, coplanar cross bars fastened at right angles to the support bars, said cover comprising:

(a) a general planar, rectangular sheet of material adapted to rest upon the cross bars of the wire shelf, said sheet of material having a front edge, a back edge, a pair of side edges and a generally flat surface for resting on the cross bars of the wire shelf; and (b) securing means fastened to said sheet of material and adapted to engage at least a portion of the wire shelf to retain said sheet of material in a fixed position relative to the wire shelf, said securing means including at least one tab which is coplanar with the sheet of material and bendable to extend downwardly from at least one of said front edge and said back edge, to fit between an adjacent pair of the cross bars of the shelf, and to lockingly engage the adjacent cross bars.

7. The cover of claim 6 wherein said tab has an outer tapered portion to facilitate the insertion of said tab between the adjacent pair of cross bars.

8. The cover of claim 6 wherein said tab is provided with a score line at the juncture of said tab and said sheet of material, to facilitated the downward bending of said tab from said sheet of material.

9. The cover of claim 6 wherein the periphery of said tab has a pair of opposing notches at the juncture of said tab and said sheet of material.

10. The cover of claim 6 wherein said tab is integral with said sheet of material.

11. The cover of claim 6 wherein said sheet of material is provided with ribs on said generally flat surface of said sheet of material, said ribs extending between said front edge and said back edge and at right angles thereto to facilitate the retention of said sheet of material in a fixed position relative to the wire itself.

12. The cover of claim 6 wherein said sheet of material has at least one line of perforation extending between said front edge and said back edge and at right angles thereto to facilitate the dimensioning of said sheet of material to a length similar to the length of the wire shelf with which it is adapted to be used.

13. A cover and wire shelf assembly comprising:

(a) a wire shelf having at least two parallel, spaced apart support bars and a plurality of parallel, spaced apart, coplanar cross bars fastened at right angles to said support bars;

(b) a generally planar, flexible, rectangular sheet of material adapted to rest upon said cross bars of said wire shelf, said sheet of material having a front edge, a back edge, a pair of side edges and a generally flat surface for resting on said cross bars of said wire shelf; and (c) securing means fastened to said sheet of material and adapted to engage at least a portion of said wire shelf to retain said sheet of material in a fixed position relative to said wire shelf, said securing means including at least one tab which is integral with said sheet of material and coplanar therewith, and bendable to extend downwardly from said sheet of material, to fit between an adjacent pair of said cross bars of said wire shelf, and to lockingly engage said adjacent cross bars.

14. The assembly of claim 13 wherein said tab has an outer tapered portion to facilitate the insertion of said tab between said adjacent pair of said cross bars, and wherein said tab is provided with a score line at the juncture of said tab and said sheet of material, to facilitate the downward bending of said tab from said sheet of material.

15. The cover of claim 13 wherein said sheet of material has a thickness of from about 0.010 inches to about 0.020 inches.

16. The cover of claim 13 wherein said sheet of material is provided with ribs on said generally flat surface, said ribs extending between said front edge and said back edge and at right angles thereto to facilitate the retention of said sheet of material in a fixed position relative to said wire shelf.

* * * * *